US006274226B1

(12) United States Patent
Londo et al.

(10) Patent No.: US 6,274,226 B1
(45) **Date of Patent: *Aug. 14, 2001**

(54) MESOPOROUS SILICOALUMINATE PIGMENTS FOR USE IN INKJET AND CARBONLESS PAPER COATINGS

(75) Inventors: Michael G. Londo, Macon, GA (US); Xiaolin Yang, Edison, NJ (US); Raymond H. Young, Macon, GA (US)

(73) Assignee: Engelhard Corporation, Iselin, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/378,883

(22) Filed: Aug. 23, 1999

(51) Int. Cl.[7] ..... B41M 5/00

(52) U.S. Cl. ..... 428/211; 428/328; 428/329; 428/331

(58) Field of Search ..... 503/225; 428/195, 428/211, 329, 331, 328

(56) References Cited

U.S. PATENT DOCUMENTS

| | | | |
|---|---|---|---|
| 3,622,364 | 11/1971 | Sugahara et al. | 106/288 |
| 4,118,247 | 10/1978 | Marchetti et al. | 106/308 |
| 4,405,371 | 9/1983 | Sugahara et al. | 106/21 |
| 4,446,174 | 5/1984 | Maekawa et al. | 427/261 |
| 4,792,487 | 12/1988 | Schubring et al. | 428/342 |
| 5,350,729 | 9/1994 | Londo et al. | 503/225 |
| 5,883,035 | 3/1999 | Yang | 502/81 |

OTHER PUBLICATIONS

Das Papier, 1998, vol. 52, pp. V109–V115 CA130:5055, No month.

*Primary Examiner*—Bruce H. Hess
(74) *Attorney, Agent, or Firm*—Inez L. Mozelle; Stephen I. Miller

(57) ABSTRACT

Disclosed is a process of making pigment coated paper useful for both carbonless copy paper and inkjet printing paper. The pigment comprises mesoporous silico-aluminates from calcium bentonite by controlled extraction of octahedral aluminum under mild condition, by acid, preferably phosphoric acid. The mesoporous silicoaluminates contain only tetrahedral aluminum as the residual aluminum. As the result of the selective removal of the octahedral aluminum, the mesoporous silico-aluminates have several unprecedented properties compared to products produced by conventional processes either by mild acid-activation or by a removal of all the aluminum. The mesoporous silicoaluminates are formulated with polyvinyl alcohol as the binder.

10 Claims, No Drawings

MESOPOROUS SILICOALUMINATE PIGMENTS FOR USE IN INKJET AND CARBONLESS PAPER COATINGS

RELATED APPLICATION

This patent application is related to U.S. Pat. No. 5,883,035. The teachings of said patent are incorporated herein in full by cross-reference.

FIELD OF THE INVENTION

This invention relates to novel mesoporous silicoaluminate pigments obtained by controlled extraction of octahedral aluminum from a calcium bentonite clay by an acid, preferably phosphoric acid, leaving mesoporous silicoaluminate containing tetrahedral aluminum in the solid residue. These novel pigments are demonstrated to be useful as components in coatings for inkjet and carbonless paper coatings.

BACKGROUND OF THE INVENTION

Calcium bentonite clays, i.e., clay in which the principal exchangeable cation is a calcium ion, are also referred to as sub-bentonites, or calcium montomorillonites. Generally, these are hydrated aluminosilicate crystalline minerals. Usually, magnesium proxies for some of the aluminum in the crystals of the clay. Iron content varies with clays from different deposits.

For many years, selected bentonite source clays have been treated on a commercial scale with acids to leach aluminum from the structure. The acid leaching has been practiced to produce bleaching earths, cracking catalysts and reactive pigments for the CF paper for carbonless copying paper systems. See U.S. Pat. No. 4,405,371 Sugahara et al, U.S. Pat. No. 3,622,364, Sugahara et al and U.S. Pat. No. 4,118,247, Marchetti et at. It has been reported (CA130:5055) that mixtures of acid leached bentonite and kaolin are useful in formulating coating pigments for inkjet printing. Reactive pigment systems for producing carbonless CF sheets that use an acidic resin plus porous pigments are disclosed in U.S. Pat. No. 5,350,729 Londo et at.

The starting clays which are used to produce heretofore known forms of acid leached bentonites typically contain approximately 20% alumina (based on the dry weight). The aluminum in bentonites is in octahedral and tetrahedral bonding structures. Acid dosages of about 40–50 gm of 96% $H_2SO_4$/100 gm clay are typically used. Alkaline earth and alkali metals are removed. The clays are usually leached to a residual aluminum content in the range of about 10–15 wt. %. The extent of leaching varies inter alia with the intended use of the leached clay. However, in general practice, both octahedral and tetrahedral aluminum remain in the solid residue which, when studied by XRD, exhibits lines characteristic of the clay crystals. The acid treated clay is invariably washed to remove soluble salts and entrained acid. While sulfuric acid is usually the acid of choice, other acids such as phosphoric and oxalic acids have been proposed.

It is known that repeated sulfuric acid leaches, resulting in extractions in excess of those used in the typical commercial prior art practice, can produce siliceous residues with essentially no aluminum. The porosity (surface area and pore volume) can be severely destroyed by such practice. This may explain why exhaustive leaching to remove virtually all aluminum has not been practiced commercially.

Acid-activated bentonites had been used as reactive pigments for several decades for paper products, in particular for use as a porous pigment in developer sheets for carbonless copy paper manufacture. The acid-leached bentonite was used with an oily solution of normally colorless leuco dyes encapsulated in microcapsules to develop colored images. In the case of U.S. Pat. No. 4,405,371, Sugahara et al proposed to use a relatively highly leached bentonite. The bentonite was leached by $H_2SO_4$ or HCI to such a degree that the SiO2 content was about 82–96.5 wt. %, preferably 85–95 wt. %. The acid-leached bentonite was characterized by its loss of X-ray crystallinity, regardless of its aluminum content or structure. However, it was noted that the acid-leached bentonite had a relatively low BET surface area, about 180 $m^2/g$. While acid treated bentonites are used as reactive pigments in carbonless paper in Europe, in the U.S. markets acidic phenolic resins are now used as the color developer in carbonless paper.

It is known that surface characteristics of paper (or any other printing surface) play a large role in how ink will be received and appear after application to the printing surface when using inkjet printing. Thus, varying print appearances can be expected depending on whether the surface ink is being applied to is uncoated or coated paper. Printing on uncoated paper results in low qualify printing while printing on coated paper results in a higher quality print albeit of varying quality according to the nature of the paper coating composition.

Two of the more important characteristics to be controlled in color ink jet printing are depth of penetration and feathering or bleeding of the ink when applied to the paper. Too deep of a penetration results in poor color intensity. Bleeding results in poor printing definition. A more recent criterion, is to control the contact angle of the various inkjet colors (i.e., cyan, magenta, yellow and black) in a manner that the inks will substantially have the same contact angle when applied to the coated paper. When the contact angles of the various inks are substantially the same, the appearance of the ink colors are more uniform, i.e., one color does not appear more dull or more bright than another color.

A common component of inkjet paper coating compositions of the prior art is porous silica. While silica is an effective paper coating constituent, it is more expensive than clay-based pigments and has severe rheological limitations such as in the amount of coating solids and Brookfield viscosity. Thus, there is a need in the art for less expensive pigments which do not sacrifice printing qualities and desirably improve rheological properties. Furthermore, the silica-based paper does not satisfy the criteria for carbonless copy paper.

U.S. Pat. No. 446,174 is directed to a method of inkjet recording and identifies desirable properties of substrates or coatings for satisfactory color inkjet printing.

This patent purports that maintaining an $R_f$ value(ratio of traveling distance of dye to that of the solvent in the aqueous ink) of less than 0.59 produces images of high quality having high ink absorption and image density.

U.S. Pat. No. 4,792,487 describes inkjet recording medium coatings containing a high swelling montmorillonite clay and silica. Formulations include various polymeric binders including polyvinyl alcohol.

While there are many grades of coated paper intended for use as developer for carbonless copy paper and a variety of grades of coated paper useful for inkjet printing, these coated sheets cannot be used interchangeably. Specifically, most commercially available grades of paper for inkjet printing fail to produce a sufficiently intense image when the paper is used as the CF (developer) component of carbonless copying paper. On the other hand, commercially available CF sheets marketed for in carbonless paper cannot be used for inkjet printing because color clarity and definition are not adequate.

SUMMARY OF THE INVENTION

This invention results from the discovery that mesoporous particulate silico-aluminates derived from bentonite clay minerals and containing only tetrahedral aluminum in the framework are uniquely capable when used to coat paper interchangeable for use in both carbonless copy paper and inkjet printing paper when applied to paper in the form of an aqueous fluid containing a specific type of film-forming binder, namely polyvinyl alcohol (PVOH).

The term "mesoporous" as used herein refers to a pore diameter (volume average) of about 20–100 Å, measured by $N_2$ adsorption.

The mesoporous silicoaluminates used in practice of this invention contain 6.0 to 0.5 weight % $Al_2O_3$ (based on the anhydrous weight) and have surface areas from about 300 to 730 $m^2/g$, depending on the starting clays. These silicoaluminates are obtained by selectively removing octahedral alumina from clays originally containing both octahedral and tetrahedral aluminum.

Preferably, the characteristic XRD lines of bentonite are absent in the silicoaluminate product. Only two broad peaks at about 2.2 and 23° are observable, which are due to the amorphous mesoporous silicoaluminates.

A conventional Carbonless CF (Coated Front) paper contains a pigment, developer resin, and binder. PVOH is not generally used in CF coatings as a binder in any amount because of its exceptional film forming characteristics. The formation of a binder film in CF coated paper hinders the image formation. PVOH films prevent the oily solution of leuco dye transferred from the CB (Coated Back) during the imaging process from reacting with the developer to form an image. Although the manufactures of carbonless CF papers would like to use PVOH for its strength properties, they are not willing to accept the loss of imaging when it is used as a coating binder.

It is believed that the unusually high concentration of surface hydroxyls and strong acid sites in the mesoporous aluminosilicates pigments used in practice of this invention are responsible at least in part for the outstanding performance as developer in CF carbonless sheets when used with sufficient polyvinyl alcohol (PVOH) binder to provide coated paper capable of being printing on a printing press. Prior art reactive pigments when used with a polyvinyl alcohol binder do not produce the intense color development and, generally, do not possess the surface charcteristics that result from the selective removal of octahedral aluminum. Also, the unusually high porosity of our mesoporous aluminosilicates contributes to the strong color development that permits use of the polyvinyl alcohol binder that is desirable in paper intended for inkjet and carbonless papers. Thus, coated paper of this invention can be used interchangeably for carbonless and inkjet printing. A paper mill can have one inventory or grade of coated paper and service two special markets. Alternatively, the paper coater could use the same coating formulation (pigment and binder) to coat different base sheets and/or to vary coat weight to achieve specific end-use performance.

DESCRIPTION OF PREFERRED EMBODIMENT

To prepare coated paper useful for either or both carbonless and inkjet printing, micron-size particles of mesoporous aluminosilicate (MEPSA) are mixed with a polyvinyl alcohol and water. The polyvinyl alcohol should be at least 98% alcohol, preferably 100%. Soluble grades of binder should be used or the alcohol should be solubilized in conventional manner (heat treatment) before mixing with the pigment. Satisfactory results were obtained using 40 parts by weight polyvinyl alcohol (100%) with 100 parts by weight mesoporous aluminosilicate and water sufficient to form a 25% solid slurry. The invention is not limited to these specific proportions. However, high levels of binder, for example, more than 25 parts by weight per 100 parts of pigment are preferred. Conventional paper coating techniques, well know in the art, can be used. While the coating compositions contain particulate mesoporous aluminosilicate and water as essential ingredients, conventional adjuvants such as, for example, wetting agents, dispersants, solid diluents such as kaolin clay or calcium carbonate or mixtures thereof can be used. Binders known in the art can be mixed in minor amounts with the polyvinyl alcohol. Acidic phenolic resins are not needed in producing coatings for CF sheets.

In the preferred embodiments of the invention, the pigments are mesoporous silicoaluminates with ultra high surface area (up to about 730 $m^2/g$ and usually in the range of 600 to 730 $m^2/g$) and brightness (typically about 85% to 90% using the TAPPI procedure). Mesoporous silicoaluminates derived from bentonite, such as the calcium bentonites known as Cheto (Arizona) clays, can be processed to provide materials that are highly porous and bright. Surface areas of such preferred products are typically about 600 to 730 $m^2/g$; pore volume in the range of 0.4 to 0.8 cc/g and pore diameter in the range of 30–60 Angstrom units.

In practice of the invention, one preferred acid used to treat the bentonite is phosphoric acid. The range of phosphoric acid concentration is preferably 1–6 M when producing high BET surface area products at reasonable leaching time at 95° C. Especially preferred is the use of 2–4 M $H_3PO_4$ when producing high surface area products using 2–10 hours leaching time at 95° C.

Generally the minimum acid concentration is about 1.0 M; using lower concentrations leaching time may be excessive even at 100° C. The maximum concentration is about 6.0 M. Use of stronger acid can result in a reaction that is too vigorous to control.

Optimum temperature varies with the concentration of the acid. Preferred leaching temperature is in the range 70–100° C. Especially preferred are temperatures in the range 90 to 100° C.

In another preferred embodiment of the invention, the mesoporous silicoaluminate pigment is derived using oxalic acid ($H_2C_2O_4$). The MEPSA thus produced usually has a lower surface area, about 300–500 $m^2/g$, but higher pore volume, pore size and aluminum content. Both XRD and $^{29}Si$ NMR provide evidence that the acid leaching has removed almost all the octahedral aluminum from the clay and transformed the layered bentonite into an amorphous silica-like structure.

Mesoporous silicoaluminate products of the invention may be prepared by batch or continuous operations, preferably employing continuous agitation either by mechanical stirring or by bubbling steam into the system.

After reaction is complete, the mesoporous silicoaluminate is separated from the bulk of the liquid by known means such as filtration or centrifugation. The residues are washed, preferably with deionized water, to reduce $H_3PO_4$ residual to below 1.0 wt. %, expressed by $P_2O_5$. The washed residues are dried and pulverized by conventional means such as fluid energy milling to break down agglomerates to micron-size particles, for example, particles in the size range of about 2 to 10 microns.

Before acid-leaching, clays can be processed by drying and crushing into powder. Typically particle size of the powders is about 10–40 micrometer in diameter.

A suitable but nonlimiting source of clay useful in preferred practice the invention has the following composition (on a dry weight basis):

| Source Clay | |
|---|---|
| (wt %): | Cheto (Arizona) |
| SiO2 | 66.7 |
| Al2O3 | 19.9 |
| CaO | 3.4 |
| MgO | 6.1 |
| Fe2O3 | 1.9 |
| TiO2 | 0.3 |

In one especially preferred embodiment of the invention a mesoporous silicoaluminate material, dubbed MEPSA-1, with a high surface area of about 720 to 730 $m^2/g$, is synthesized. The high surface area can be obtained only when $H_3PO_4$ acid and a special smectite clays are used. Such bentonite clays are mined in the Cheto deposit and are supplied under the trade name F2 by Engelhard Corporation. To our knowledge, products obtained by practice of this invention using such clays have the highest surface areas of acid-leached bentonites ever achieved.

High surface area is related to the removal of aluminum in the clay. However, a maximum surface area is obtained only when some or all the tetrahedra aluminum ($Al_2O_3$ 0.5–2.0 wt. %) remains in the structure. A complete removal of aluminum leads to a destruction of some of the porosity.

Both XRD and NMR data are definitive that MEPSA-1 is no longer a bentonite. Chemical analysis data also indicate that the acid-treatment has significantly reduced alumina content typically from 20 to 1.3 wt. % and increased the Si content from 67 to 95 wt. %.

X-ray diffraction evaluations reported herein were performed on a Philips APD 3720 diffractometer. The instrument settings are:

| | |
|---|---|
| Voltage: | 45 kV |
| Current: | 40 mA |
| Radiation: | Cu-k 1.5406 Å |
| Divergency slit: | automatic compensator |
| Receiving slit: | 0.2 mm |
| Monocromator: | graphite |
| Scan range (2θ): | 1–40° |
| Step size | 0.04° |
| Count time: | 2 sec/step |

Solid-state nuclear magnetic resonance (NMR) was used to determine the local structure of the starting bentonite clays and the end silica products. This method is particularly useful in determining the type and amount of aluminum in the materials. All the high resolution NMR spectra were taken from a Varian Unity-400MHZ spectrometer at room temperature under a so-called magic angle spinning (MAS) condition. The aluminum NMR spectra were taken using a Doty 5mm probe with MAS at about 11kHz spinning speed.

The chemical composition analysis was performed with a standard X-ray fluorescence technique. The elemental composition was based on a volatile free weight basis (1000° C.). For all the analyzed elements of the clays and the silicon in MEPSA, the accuracy is within ±0.1 wt. %. For the low aluminum residual in MEPSA, the accuracy is within ±0.5 wt. %.

The BET surface area, pore volume, and pore size were determined by nitrogen gas adsorption at liquid nitrogen temperature, using either of two automated instruments: Quantachrome® Autosorb-6 or Micrometrics® ASAP2400.The samples were heated at 250° C. under vacuum for at least 6 hours before the analysis. The sample weight was obtained on a dried sample. The surface area was obtained by B.E.T. method with 39 relative pressure points. The pore volume represents the total pore volume with pore radius less than 1000 Å.

TAPPI brightness and yellowness were measured using a Technidyne-S4M and Technidyne-MicroTB1C instrument, respectively. The TAPPI brightness is also referred to as GE or Germ brightness. The samples were ground to 325 mesh for the analysis. The instruments were calibrated against the manufacturer's master instruments. A sample of fully calcined kaolin sample supplied by Engelhard Corporation was used as a reference.

In some cases, abrasion was measured using an Einlehner abrasion apparatus. An aqueous slurry containing 15 wt. % solids and 87,000 revolution of abrasion (equivalent of 40 minutes) were used.

The following examples are given for illustrative purposes.

EXAMPLE 1

In this example, the two MEPSA compositions were evaluated. One was the material denoted hereinabove as MEPSA-1 which has a BET surface area of about 720 $m^2/g$. The pigment was prepared by leaching Cheto bentonite clay with 3M phosphoric acid in a ratio of 1g/10 ml, stirring at 95° C. for 2½ hour, washing, drying and pulverizing.

MEPSA-2 was prepared by leaching Cheto bentonite clay with 2M oxalic acid with clay/acid ratio of 1g/10ml, stirring at 95C. for 6.0 hours, washing, drying and pulverizing.

Table 3 summarizes the chemical composition, pore structures, and brightness of the two MEPSA samples. Although not the best MEPSA we have made, the above two samples were used as the pigments in the inkjet and carbonless paper coating experiments described in Example 2.

TABLE 1

Summary of Chemical and Physical Properties of MEPSAs

| | MEPSA-1 | MEPSA-2 |
|---|---|---|
| Starting Clay | F-2 | F-2 |
| Acid | 3M $H_3PO_4$ | 2M $H_2C_2O_4$ |
| Acid/Clay (ml/g) | 10 | 10 |
| Temperature © | 95 | 95 |
| Time (Hour) | 2.5 | 6.0 |
| $SiO_2$ | 96 | 87.4 |
| $Al_2O_3$ (wt %) | 1.6 | 6.4 |
| $Fe_2O_3$ (wt %) | 0.18 | 0.55 |
| CaO (wt %) | 0.1 | 3.3 |
| N2 BET ($m^2/g$) | 668 | 373 |
| Pore Diameter (A) | 33 | 73 |
| Pore Volume (cc/g) | 0.56 | 0.68 |
| Particle Size (μm) | 5 | 5 |
| TAPPI Brightness | 84 | 88 |
| TAPPI Yellowness | 2.4 | 2.6 |

The pigments were prepared into coating compositions by mixing pigment with a heat solubilized polyvinyl alcohol binder. The pigment was mixed with a 98% medium molecular weight polyvinyl alcohol (AIRVOL) binder and water to form a 25% solid coating. The polyvinyl alcohol was cooked at 190° F. in conventional manner before being formed into the coating composition. The coating was applied to a paper substrate by means of a Meyer rod in conventional manner. Coat weight was $3.3^{\#}/3300\ ft^2$. Paper for inkjet coating was evaluated by the test described in copending U.S. Patent Application (Attorney Docket 3267). (That test is incorporated herein by cross-reference.) A conventional method for measuring image development in a CF (image developing) sheet using commercially available (Mead Corporation) CB sheets (based on a proprietary encapsulated oily solution of leuco dye) was used. The combination of blue, black, yellow, green and red dyes in the oily solution produces a black image.

Results of the tests are summarized in Table 2.

TABLE 2

| Inkjet Printing Testing | | | |
|---|---|---|---|
| Color Ink | HP Premium | MEPSA-1 | LDX* |
| BLK | 1.97 | 1.96 | 1.95 |
| Red | 1.81 | 1.27 | 1.22 |
| Yellow | 1.21 | 1.13 | 1.10 |
| Cyan | 2.50 | 2.06 | 1.66 |
| Magenta | 1.87 | 1.68 | 1.40 |

*Control-Silica

This data clearly shows that MEPSA-1 is useful as an inkjet coating pigment.

Carbonless paper opacity test reading results are summarized in Table 3.

TABLE 3

| Carbonless CF Copy Paper Testing | | | | |
|---|---|---|---|---|
| Sample | 30 sec | 60 sec | 90 sec | 120 sec |
| Control | 44.6 | 42.4 | 41.8 | 41.4 |
| MEPSA-1 | 59.9 | 59.0 | 58.1 | 57.4 |
| LDX (Control, $SiO_2$) | 97.1 | 96.7 | 96.6 | 96.5 |

This data reflects an opacity reading. The lower the number the better. The "Control" is a fully formulated CF containing a alkyl-phenolic based developer resin and a mixture of calcined kaolin and structural kaolin as described in Example 1 of U.S. Pat. No. 5,350,729 (Londo et al). Both the LDX (Control $SiO_2$) and MEPSA-1 do not contain any developer resin. They are formulated solely with pigment and binder.

The data show that only MEPSA-1, a mesoporous aluminosilicate, had outstanding utility in both inkjet printing and carbonless copy paper. Note that even though polyvinyl alcohol was used as the binder with the control porous silica, color development was inadequate when used for carbonless copy paper. It was noted that color development when using MEPSA-1 was very rapid.

To assess the tenacity of the image developed with MEPSA-1, a conventional Scotch® Tape pull test was carried out with satisfactory results. Thus, it was concluded that the developed sheets could be printed in a conventional printing press.

EXAMPLE 2

This example focuses on procedures for improving the brightness of mesopored silicoaluminates from Cheto clay, especially those intended for use in the paper industry. The effect of starting clays, the types of acids and other leaching conditions were examined. A possible correlation between the brightness and the porosity and composition of mesoporous silicoaluminates was investigated.

It was found that, under similar acid-treatment conditions (3M $H_3PO_4$,/95° C.), of various bentonite, attapulgite, and mica clays, only F2 bentonite clay gives a high brightness and low yellowness that is suitable for some paper applications. The unique behavior of F2 is probably due to its low initial $Fe_2O_3$(1.9 wt. %) and $Al_2O_3$ (19.9 wt. %) contents.

Porosity, brightness, yellowness, and abrasion data of four mesoporous silicoaluminate samples obtained using both mineral acids, $H_3PO_4$, $H_2SO_4$, and HCl, and an organic acid, $H_2C_2O_4$, were obtained. The data indicate that:

1. All the acids are effective in obtaining high brightness that is suitable for paper coating application, though the reaction conditions are different for each acid;
2. With an equal or similar brightness, the BET surface areas are significantly different from one sample to another, indicating there may not be a correlation between the porosity and the brightness. The porosity has been maximized by changing the reaction time. The wide range of the porosity obtained by applying different acids allows one to fine-tune the mesoporous silico-aluminates to match a specific requirement for paper coating.
3. Based on two measurements, it was found that mesoporous silicoaluminates has a relative low Einlehner abrasion (7–13), which is important for paper coating.
4. The mesoporous silicoaluminate obtained by $H_2C_2O_4$-leaching gives an unusually high brightness at a relatively high $Al_2O_3$ and $Fe_2O_3$ content. It was also noticed that Ca content in the two $H_2C_2O_4$-leached samples is high. It was concluded that this must be due to the $CaC_2O_4$ precipitate formed by the reaction, $$Ca^{+2}+C_2O_4^{-2}®CaC_2O_4$$

Like $CaCO_3$ which is commonly used in the paper coating, $CaC_2O_4$ may contribute in part to the high brightness. For this reason, the special mesoporous silicoaluminate from $H_2C_2O_4$-leached Cheto clay was designated MEPSA-2.

EXAMPLE 3

Most current commercial bentonite acid activation processes use $H_2SO_4$. This example shows that $H_2SO_4$ gives a significantly improved porosity and stability than conventional process, but not as good as $H_3PO_4$ leaching in items of BET surface area.

The experimental procedures was as follows: 200g of as received F 100 clay was added to 2 liter 3M $H_2SO_4$ aqueous solution. After 4 hours at 95° C. with stirring, the slurry was filtered and washed with hot de-ionized water for three times, and dried at 105° C. overnight.

The resulting MEPSA has a $N_2$ BET surface area of 608 $m^2/g$, pore volume 0.64 cc/g, and pore diameter 41Å. The $SiO_2$ and $Al_2O_3$ contents are 94.2 and 4.5 wt. %, respectively.

What is claimed is:

1. Paper coated with a pigment comprising a mesoporous silicoaluminate residue of calcium bentonite clay having a BET surface area in the range of about 300 to 730 $m^2/g$ and a pore volume in the range of 0.4 to 0.8 cc/g, a pore diameter in the range of 30–80 Å units, said residue containing tetrahedral aluminum but no octahedral aluminum and a polyvinyl alcohol binder.

2. The paper of claim 1 wherein the mesoporous silicoaluminate residue of calcium bentonite clay has a BET surface area in the range of about 600 to 730 $m^2/g$, and a pore diameter in the range of 30 to 80 Å units.

3. The paper of claims 1 or 2 wherein said paper is used as the CF sheet in a carbonless copy paper system or in inkjet printing.

4. The paper of claims 1 or 2 wherein said paper can be used interchangeably in a carbonless copy paper system and in an inkjet printing system.

5. The paper of claim 1 wherein said polyvinyl alcohol contains at least 98% by weight alcohol.

6. The paper of claim 5 wherein said polyvinyl alcohol contains 100% by weight of alcohol.

7. The paper of claim 5 wherein at least 25 parts by weight of polyvinyl alcohol binder are used to 100 parts by weight of said pigment.

8. The paper of claim 7 wherein about 25 parts by weight of polyvinyl alcohol binder are used to 100 parts by weight of said pigment.

9. The paper of claim 1 wherein the weight of coating on said paper is in the range of 3 to 6 pounds per 3300 square part.

10. The paper of claim 1 wherein the coating consists of said pigment and said polyvinyl alcohol.

* * * * *